United States Patent [19]

Sakai et al.

[11] 4,134,342

[45] Jan. 16, 1979

[54] BALLAST TAMPING APPARATUS

[75] Inventors: Tetsuo Sakai, Suita; Shigezo Shiraishi, Osaka; Choichi Kimura, Yokohama; Maki Nakajimi, Yokohama; Hitoshi Sato, Yokohama, all of Japan

[73] Assignees: Nippon Kokuyu Tetsudo; K.K. Shibaura Seisakusho, both of Japan

[21] Appl. No.: 829,048

[22] Filed: Aug. 30, 1977

[30] Foreign Application Priority Data

Sep. 16, 1976 [JP] Japan ..... 51/111028

[51] Int. Cl.[2] ..... E01B 27/16

[52] U.S. Cl. ..... 104/12; 104/10

[58] Field of Search ..... 104/7 R, 10, 12

[56] References Cited

U.S. PATENT DOCUMENTS

| | | | |
|---|---|---|---|
| 3,343,497 | 9/1967 | Stewart | 104/12 |
| 3,625,156 | 12/1971 | Anderson | 104/12 |
| 3,669,025 | 6/1972 | Plasser et al. | 104/12 |
| 4,062,292 | 12/1977 | Derler | 104/12 |

*Primary Examiner*—Albert J. Makay
*Assistant Examiner*—Carl Rowold
*Attorney, Agent, or Firm*—Stevens, Davis, Miller & Mosher

[57] ABSTRACT

Apparatus comprising a pair of tamping machines mounted in side-by-side disposition on a railway vehicle on a railway track for consolidating ballast supporting the railway track. Each tamping machine comprises two pairs of normally opposed tamping units juxtaposed on a carriage for simultaneous up-and-down motion therewith between a retracted and an operating position. Included in each tamping unit pair is a pair of tamping tools which, while being driven into ballast on opposite sides of a crosstie, are both vibrated and oscillated for compacting the ballast. For use of the machine at a railway switch or over guardrails, a swivelling mechanism comprising an adjusting bolt is provided for pivoting each pair of tamping units about vertical axes and holding the same in desired angular positions with respect to the carriage.

4 Claims, 6 Drawing Figures

BALLAST TAMPING APPARATUS

BACKGROUND OF THE INVENTION

This invention relates to consolidating or compacting apparatus in general and in particular to a machine for tamping or packing railway ballast, especially under and around crossties or sleepers, in order to provide a firm ballast for the track and for the rolling stock running thereon.

Vehicle-mounted tamping machines comprising pairs of cooperative tamping tools have been known and used extensively for compacting ballast laid in or forming a roadbed for a railway track. Driven into the ballast, each pair of tamping tools are vibrated and further oscillated toward and away from each other about horizontal axes extending in the transverse direction of the track, that is, in the longitudinal direction of the crosstie. This type of tamping machine has long had a problem in regard to its use as at the location of a railway switch or of guardrails laid alongside main rails as a safeguard against derailment. In the presence of such obstacles, the tamping tools cannot possibly be fed into the ballast if they are held in usual positions on the vehicle.

With a view to overcoming this problem, a tamping machine has been suggested wherein the spacing between the pairs of tamping tools is made adjustably variable in the transverse direction of the track. This known machine is still unsatisfactory, however, because the tamping tools displaced from their normal positions to avoid the above noted obstacles operate to tamp ballast some distance away from the loaded points of the crossite as they oscillate about horizontal axes extending in the transverse direction of the track.

SUMMARY OF THE INVENTION

It is an object of this invention to provide an improved tamping machine capable of effectively and firmly compacting ballast supporting a main-line track, even in the presence of such obstacles as switches and guardrails.

Another object of the invention is to provide a relatively inexpensive and highly durable tamping machine which is easily manufactured and operated.

Another object of the invention is to provide apparatus comprising a pair of tamping machines of the character described which may be mounted in juxtaposition on a rail vehicle for highly efficient tamping operation.

Summarized in its simplest form, the tamping machine in accordance with this invention comprises at least one pair of normally opposed tamping units mounted on a carriage for up-and-down motion therewith relative to frame means. The tamping units comprise a pair of swivel brackets mounted on the carriage for pivotal motion about vertical axes, a pair of tamping brackets each having a tamping tool extending downwardly therefrom and each mounted on one of the swivel brackets for pivotal motion about a horizontal axis, means on the swivel brackets for oscillating the tamping brackets together with the tamping tools about the horizontal axes, and means on the tamping brackets for vibrating the tamping tools. Further included in the tamping machine is means for adjustably pivoting the swivel brackets, and therefore the complete tamping units, about the vertical axes and holding same in desired angular positions with respect to the carriage.

Preferably, the tamping machine comprises two such pairs of tamping units disposed side by side on the carriage. Further, in a preferred embodiment of the invention, the machine is paired up with another tamping machine of identical construction, and both are mounted on a railway vehicle in side-by-side disposition.

Thus, where a guardrail is placed on either side of a main rail, for example, the particular pair of tamping units located over the guardrail may be pivoted about the vertical axes in opposite directions away from the other tamping unit pair of the same tamping machine. The tamping tools of the pivoted tamping unit pair, together with those of the other tamping unit pair, can then be driven into the ballast in the ordinary manner without being obstructed by the guardrail. Being vibrated and oscillated about the horizontal axes, the two tamping tools pairs of each tamping machine coact to compact the ballast under and around the loaded points of the tie.

The above and other objects, features and advantages of this invention and the manner of attaining them will become more apparent, and the invention itself will best be understood, from the following detailed description and appended claims, taken together with the accompanying drawings showing a preferred embodiment of the invention.

DETAILED DESCRIPTION

Figure 1:
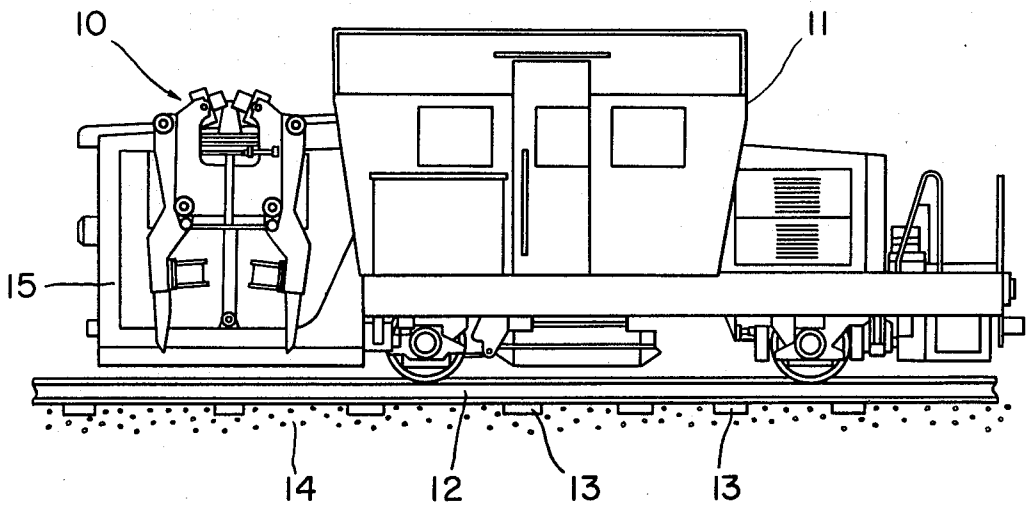
FIG. 1 is a side elevational view of one of paired tamping machines constructed in accordance with this invention and mounted in juxtaposition on a railway vehicle, with the tamping machine having its pairs of tamping units shown in an elevated or retracted position.

With reference particularly to FIG. 1 of the drawings, there is seen one of a pair of tamping or packing machines 10 in accordance with this invention which are mounted in side-by-side disposition on a self-propelled track maintenance vehicle 11 running on a pair of main-like rails 12 (one seen) of a railway track. As is well known, these rails rest on and are fastened to a series of interspaced crossties 13 which in turn are supported by ballast 14 laid in or forming a roadbed for the track.

The pair of tamping machines 10 on the vehicle 11 are disposed above respective rails 12 and are adapted to compact the ballast 14, especially under and around successive crossties 13. Since these tamping machines are identical in construction, only one of them seen in FIG. 1 will be described in detail, it being understood that the same description is applicable to the other machine (indicated by the dot-and-dash lines in FIG. 4).

Figure 2:
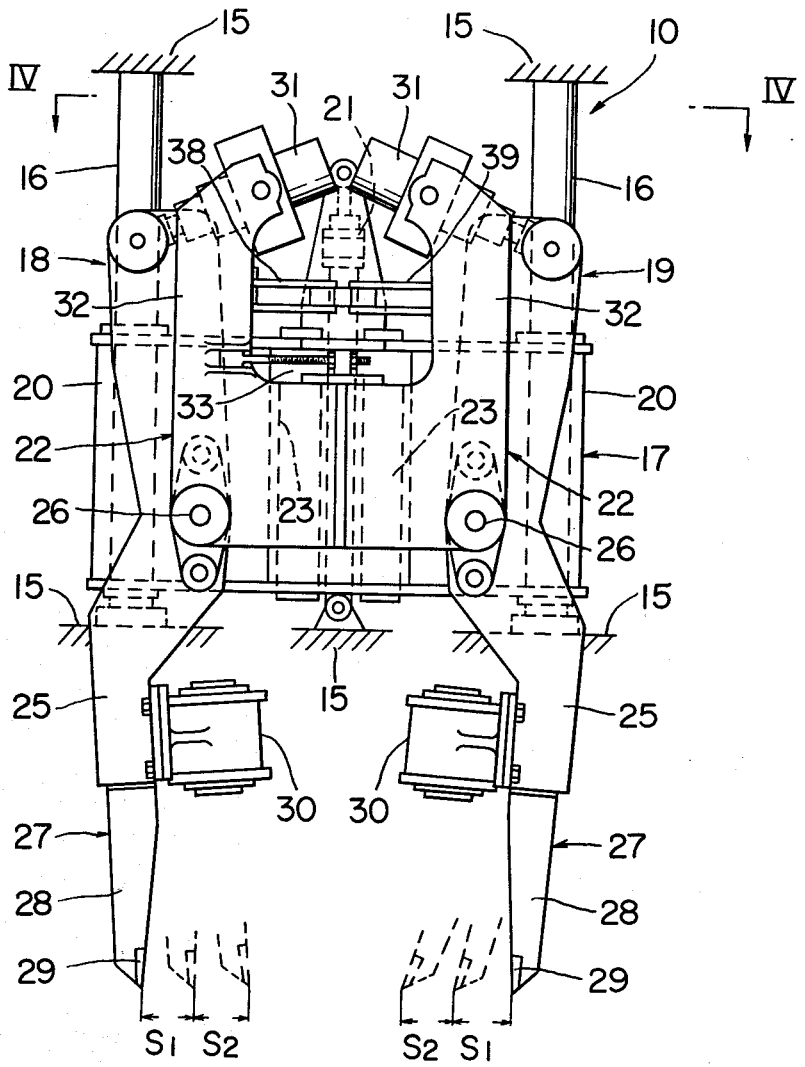
FIG. 2 is a relatively enlarged side elevational view of the tamping machine seen in FIG. 1, the view illustrating in particular one of the pairs of tamping units of the machine as held in a lowered or operating position.
Figure 3:
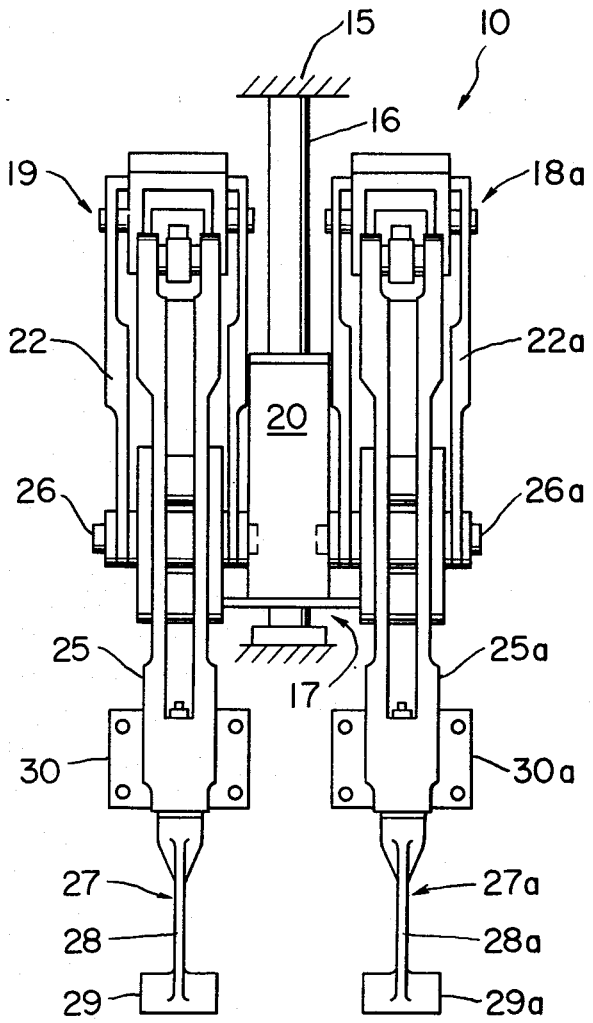
FIG. 3 is an elevational view of the tamping machine of FIG. 2 as viewed from the right hand side thereof.
Figure 4:
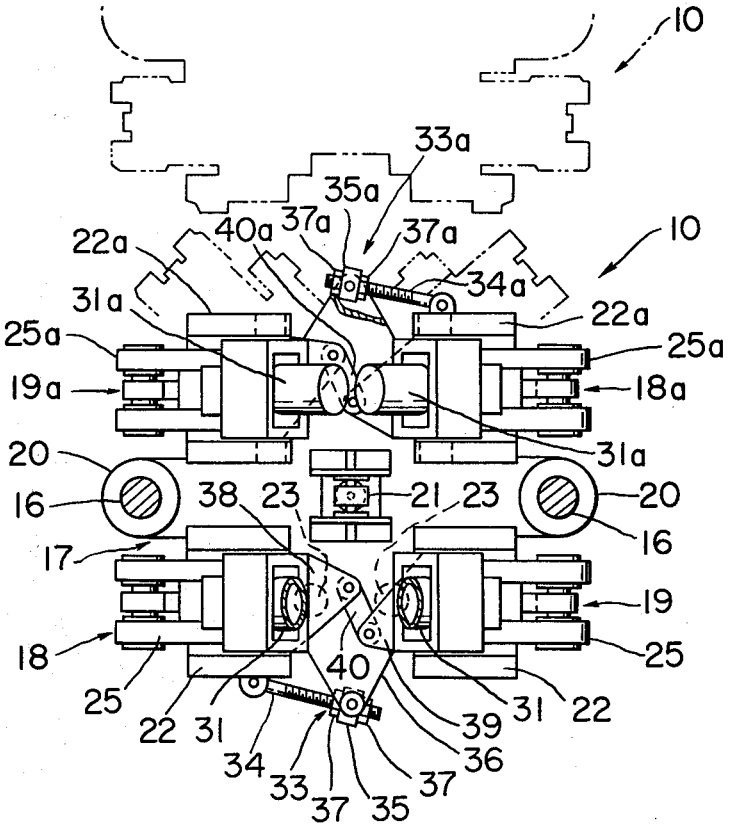
FIG. 4 is a vertical sectional view, partly broken away, taken along the line IV—IV in FIG. 2, the view also indicating by dot-and-dash lines the other tamping machine on the vehicle in its relative position with respect to the illustrated tamping machine.

As illustrated on an enlarged scale in FIGS. 2, 3 and 4, the tamping machine 10 includes a frame 15 which is suitably secured to the track maintenance vehicle 11 and which rigidly supports a pair of upstanding guide columns 16 spaced from each other in the longitudinal direction of the track. Movable up and down along this guide column pair is a carriage 17 which, in this particular embodiment of the invention, carries two pairs of tamping units 18 and 19; 18*a* and 19*a* as best shown in FIG. 4.

Figure 5:
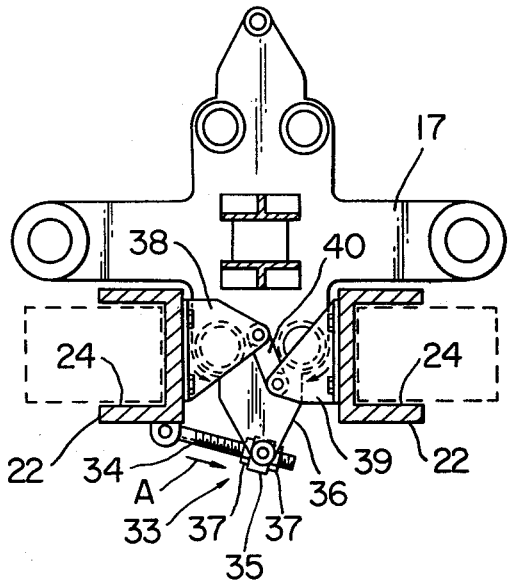
FIG. 5 is a top plan view, partly in section, illustrating in particular one of swivelling mechanisms for adjustably pivoting the respective pairs of tamping units about vertical axes with respect to a carriage on which the tamping units pairs are mounted.

It will be observed that the carriage 17 is in the shape of a cross when seen in plan view in FIGS. 4 and 5. Of the four limbs of the cross-shaped carriage 17, the two which extend in the longitudinal directon of the track have upright guide sleeve portions 20 formed at their ends remote from the central region of the carriage 17. These guide sleeve portions 20 are slidably fitted over the respective guide columns 16. A fluid-actuated lifting cylinder 21 (hereinafter referred to as the lifting cylinder), preferably of the hydraulic type, is connected between the frame 15 and carriage 17 for moving the latter, and therefore the two pairs of tamping units, between an elevated or retracted position shown in FIG. 1 and a lowered or operating position shown in FIGS. 2 and 3 along the guide column pair 16.

The two pairs of tamping units 18 and 19; 18*a* and 19*a*, juxtaposed on the carriage 17 in the transverse direction of the track, are of identical construction. Only one pair of tamping units 18 and 19 seen in FIG. 2 will therefore be described in detail, and the reference numerals used to designate various parts of this tamping unit pair will be simply affixed with subscript a to denote corresponding parts of the other pair of tamping units 18*a* and 19*a*, with the understanding that the following description of the said one tamping unit pair is directly applicable to the other tamping unit pair.

The pair of tamping units 18 and 19 which are normally held aligned in the longitudinal direction of the track and disposed opposite to each other, include a pair of swivel brackets 22 mounted on the carriage 17 for pivotal or swivelling motion about respective vertical pivot pins 23 spaced from each other in the longitudinal direction of the track. The swivel brackets 22 are shaped to define vertically extending cavities 24 (FIG. 5) for partly and loosely receiving a pair of elongate tamping brackets 25. It will be noted from FIGS. 2 and 3 that each tamping bracket 25 is pivoted at a point intermediate between the upper and lower ends thereof on a horizontal pivot pin 26 via suitable vibration absorbing means, each horizontal pivot pin 26 being supported at the lower end of one of the swivel brackets 22.

A pair of tamping tools 27, which are exchangeably fixed to the respective tamping brackets 25, extend downwardly therefrom. Each tamping tool 27 has a shank 28 terminating in a rectangularly shaped tamping blade 29 normally oriented to face the other tamping blade. A vibrator unit 30 is rigidly attached to the lower end of each tamping bracket 25 for imparting vibration to the respective tamping tool 27 therethrough.

Further included in the tamping units 18 and 19 are a pair of fluid-actuated adjustable-stroke cylinders 31 (hereinafter referred to as the oscillating cylinders), preferably of the hydraulic type, respectively for oscillating the tamping brackets 25 complete with the tamping tools 27 about the horizontal pivot pins 26. These oscillating cylinders 31 are each pivotally mounted, via suitable vibration absorbing means, on the top of one of the upward extensions 32 of the swivel brackets 22 and are each operatively connected to the upper end of the corresponding one of the tamping bracket 25.

In this particular embodiment of the invention, the working stroke of each oscillating cylinder 31 is variable to provide: a first stroke, resulting in a tamping tool oscillation stroke S1 as indicated in FIG. 2; a second stroke, resulting in a tamping tool oscillation stroke S2; and a full stroke, resulting in a tamping tool oscillation stroke S1 + S2. The pair of tamping tools 27 are thus both oscillated and vibrated for compaction of the ballast 14, as will be later described in more detail.

The reference numeral 33 in FIGS. 2, 4 and 5 generally designates a swivelling mechanism for adjustably pivoting the pair of swivel brackets 22, and therefore the complete pair of above described tamping units 18 and 19, about the vertical pivot pins 23 and for holding same in desired angular positions with respect to the carriage 17. It will be noted from FIG. 4 that another swivelling mechanism 33*a* is provided for the other pair of tamping units 18*a* and 19*a*. The two swivelling mechanisms 33 and 33*a* also are of identical construction. Only the swivelling mechanism 33 will therefore be described in detail, and the reference numerals used to designate various parts of this mechanism will be affixed with the subscript a to denote corresponding parts of the other swivelling mechanism 33*a*.

The swivelling mechanism 33 comprises an adjusting bolt 34 coupled at one end to the swivel bracket 22 of the tamping unit 18 so as to be pivotable in a horizontal plane. The adjusting bolt 34 has its other end portion somewhat loosely inserted into and through a sleeve 35 supported at the tip of a bifurcated carriage portion 36 extending transversely of the track and located between the pair of tamping units 18 and 19, the sleeve 35 being pivotable about a vertical axis relative to the carriage 17. A pair of adjusting nuts 37 are fitted over and meshed with the screw threads of the bolt 34 and disposed on opposite sides of the sleeve 35. The swivel bracket 22 of the tamping unit 18 can therefore be pivoted about the vertical pivot pin 23 by turning the paired nuts 37 around the adjusting bolt 34.

For transmitting such pivotal motion of the swivel bracket 22 to the other swivel bracket 22, belonging to the tamping unit 19, a pair of horizontally extending, vertically spaced 38 brackets are fixed to and project from the upward bracket extension 32 of the tamping unit 18 toward the other tamping unit 19. A similar pair of brackets 39 project from the upward bracket extension 32 of the tamping unit 19 toward the tamping unit 18. The two pairs of brackets 38 and 39 are disposed in coplanar relationship to each other but are spaced in the transverse direction of the track. A link 40 has its ends pivotally coupled to the respective bracket pairs 38 and 39.

Normally, or for usual tampling operation, the pair of tamping units 18 and 19 (and the other pair of tamping units 18*a* and 19*a*) are held aligned in the longitudinal direction of the track, as best shown in FIG. 4. If the paired nuts 37 on the adjusting bolt 34 are turned in such a direction as to pull the bolt 34 as indicated by the arrow A in FIG. 5, the complete tamping unit 18 will be pivoted counterclockwise, as viewed in FIGS. 4 and 5, about the vertical pivot pin 23. This pivotal motion of the tamping unit 18 is transmitted via the link 40 to the other tamping unit 19, causing the same to pivot clockwise about its own vertical pivot pin 23.

It is thus seen that by turning the paired adjusting nuts 37 of the swivelling mechanism 33, the pair of tamping units 18 and 19 can be simultaneously pivoted in opposite directions away from or back to the illustrated normal positions with respect to the carriage 17. No particular locking mechanism is required for retaining the tamping unit pair in desired angular positions. It will also be apparent that the two pairs of tamping units 18 and 19 and **18*a* and 19*a*** can be pivoted as described above independently of each other.

In operation, during the travel of the vehicle 11, the two pairs of tamping units of each tamping machine 10 should be held retracted as shown in FIG. 1 by holding the carriage 17 in the elevated position by means of the lifting cylinder 21. Further, each pair of tamping units can be held aligned in the longitudinal direction of the track.

To initiate a tamping operation, the vehicle 11 is stopped in such a position that the pair of tamping machines 10 thereon are positioned over one of the crossties 13 under which the ballast 14 is to be compacted, with the tamping tools 27 or **27*a* of each tamping unit pair disposed on opposite sides of the tie. The lifting cylinder 21 of each tamping machine is then actuated to lower the carriage 17, together with the two pairs of tamping units thereon, to the operating position of FIGS. 2 and 3, thereby causing the pairs of tamping tools 27 and 27*a* to penetrate into the ballast 14**.

The penetration of the tamping tools 27 and **27*a* into the ballast will be greatly facilitated if, during the descent of the carriage 17, the vibrator units 30 and 30*a* are kept in operation to vibrate the tamping tools, and/or if the oscillating cylinders 31 and 31*a* are kept in operation to oscillate the tamping tools with the tamping bracket 25 and 25*a***. The vibrating and/or oscillating tamping tools will easily penetrate the ballast to a required depth, without scattering the ballast gravel in so doing.

Driven fully into the ballast 14 in the above described manner, the two pairs of tamping tools 27 and **27*a* of each tamping machine simultaneously start compacting the ballast under the selected tie as they are both vibrated by the vibrator units 30 and 30*a* and oscillated by the oscillating cylinders 31 and 31*a*. For ordinary tamping operation along a track where no switch, guardrail or like obstacles exist, all of the oscillating cylinders 31 and 31*a* may be set at full stroke, thereby permitting the tamping tools 27 and 27*a*** to oscillate with the maximum stroke S1 + S2. The maximum stroke oscillation of the tamping tools will result in firmer and more efficient compaction of the ballast and is therefore particularly desirable as at the joints of the rails.

Upon completion of the tamping operation, the pairs of tamping tools 27 and **27*a* of each tamping machine 10 are pulled out of the ballast by actuating the lifting cylinder 21 to elevate the carriage 17 to the retracted position together with the pairs of tamping units 18 and 19 and 18*a* and 19*a*. The vehicle 11 is then moved to transport the pair of tamping machines 10 over the next tie 13** under which the ballast is to be compacted.

Figure 6:
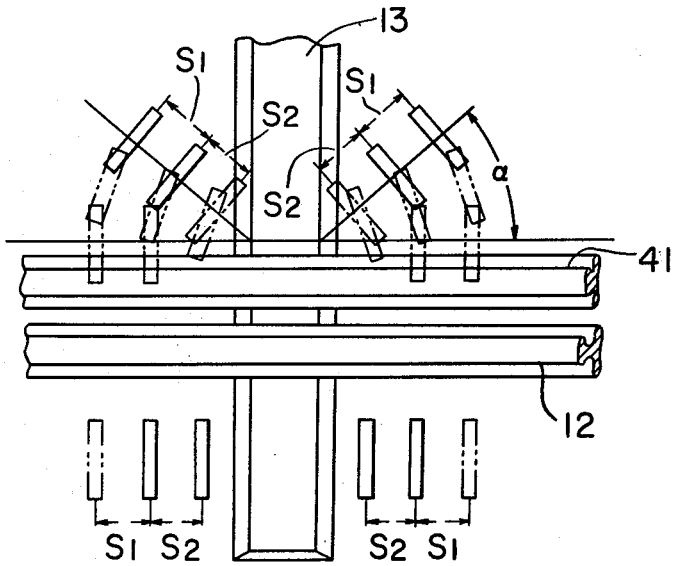
FIG. 6 is a partial plan view showing a main rail and a guardrail resting on a crosstie, the view being explanatory of the operation of the illustrated tamping machine.

FIG. 6 is explanatory of the way the illustrated tamping machine 10 is to be operated in the case where a guardrail 41 is laid on the inside of the main rail 12. In this case, while the two pairs of tamping units of the machine are held retracted as in FIG. 1, the paired nuts **37*a* of the swivelling mechanism 33*a* are turned around the adjusting bolt 34*a* thereby pivoting the inside pair of tamping units 18*a* and 19*a* through angles $\alpha$ about their unseen vertical pivot pins. The angles $\alpha$ depend principally upon the spacing between the rails 12 and the guard rail 41**.

With the inside pair of tamping units **18*a* and 19*a* held in the required angular positions, and with the outside pair of tamping units 18 and 19 held aligned in the longitudinal direction of the track, the lifting cylinder 21 is then actuated to lower the carriage 17 to the operating position together with both pairs of tamping units. The two tamping tool pairs 27 and 27*a* are thus driven into the ballast 14, with the aid of the vibrator units 30 and 30*a* and/or the oscillating cylinders 31 and 31*a*, and are then both vibrated and oscillated to effectively compact the ballast under and around those points of the crosstie 13 where the same is loaded by the main rail 12 and the guardrail 41**.

The tamping tools **27*a* of the angled inside pair of tamping units 18*a* and 19*a*, however, may strike against the crosstie 13 and/or the guardrail 41 if the tamping tools 27*a* are allowed to oscillate with the maximum stroke S1 + S2, as will be seen upon consideration of FIG. 6. In such cases, the oscillating cylinders 31*a* may be readjusted for operation with their first stroke, so that the tamping tools 27*a*** can oscillate with the stroke S1 without contacting either the tie or the guardrail.

Thus, in accordance with this invention, either or both of the two tamping unit pairs of each tamping machine can be pivoted to and held in desired angular positions about vertical axes. It is therefore evident that the tamping apparatus of the invention is particularly well adapted for compaction of railway ballast at the location of a switch or where guard-rails are laid on either or both sides of main rails.

The tamping apparatus of this invention has been shown and described in terms of its preferred form comprising the pair of tamping machines 10 fixedly mounted on a rail vahicle in side-by-side arrangement. It will be easy, however, for those skilled in the art to devise a modification wherein a single tamping machine comprising one or two pairs of tamping units is mounted on a vehicle for reciprocating motion in the transverse direction of the track. Further, although the swivelling mechanism 33, **33*a* for pivoting each pair of tamping units about vertical axes has been described as comprising a pair of nuts fitted over an adjusting bolt, this mechanism may be readily modified and adapted for remote control with the use of such means as a fluid-actuated cylinder, rack-and-pinion mechanism, or system of leverage and linkage. Still further, the working stroke of the oscillating cylinders 31 and 31*a*** may be made variable in other than the illustrated way.

All these and other modifications and equivalents within the common knowledge of those skilled in the art are intended in the foregoing disclosure.

We claim:

1. A tamping machine for compacting ballast comprising, in combination:

(a) frame means;

(b) vertical guide means supported by said frame means;

(c) a carriage movable along said vertical guide means;

(d) means for moving said carriage up and down along said vertical guide means;

(e) at least one pair of normally opposed tamping units mounted on said carriage for up-and-down motion therewith, said tamping units comprising:
(1) a pair of swivel brackets mounted on said carriage for pivotal motion about vertical axes;
(2) a pair of tamping brackets each mounted on one of said swivel brackets for pivotal motion about a horizontal axis;
(3) means on said swivel brackets for oscillating said tamping brackets about said horizontal axes;
(4) a pair of tamping tools each extending downwardly from one of said tamping brackets; and
(5) means on said tamping brackets for vibrating said tamping tools; and
(f) means for adjustably pivoting said swivel brackets of said tamping units about said vertical axes and holding the same in desired angular positions with respect to said carriage.

2. The tamping machine as set forth in claim 1, wherein said oscillating means of said tamping units comprises a pair of fluid-actuated adjustable-stroke cylinders each pivotally mounted on one of said swivel brackets and operatively connected to the corresponding one of said tamping brackets.

3. A tamping machine adapted to be carried by a railway vehicle on a railway track for compacting ballast supporting the railway track, said tamping machine comprising in combination:
(a) frame means mounted on said railway vehicle;
(b) vertical guide means supported by said frame means;
(c) a carriage movable along said vertical guide means;
(d) means for moving said carriage up and down along said vertical guide means;
(e) two pairs of normally opposed tamping units mounted on said carriage in side-by-side disposition for simultaneous up-and-down motion therewith, each pair of tamping units comprising:
(1) a pair of swivel brackets mounted on said carriage for pivotal motion about vertical axes, said swivel brackets being normally held aligned in the longitudinal direction of the track and being pivotable from the normal positions only in the directions away from the other pair of tamping units;
(2) a pair of tamping brackets each mounted on one of said swivel brackets for pivotal motion about a horizontal axis;
(3) means on said swivel brackets for oscillating said tamping brackets about said horizontal axes;
(4) a pair of tamping tools each extending downwardly from one of said tamping brackets; and
(5) means on said tamping brackets for vibrating said tamping tools; and
(f) means for adjustably pivoting said swivel brackets of a selected one of said pairs of tamping units about said vertical axes and holding the same in desired angular positions with respect to said carriage.

4. The tamping machine as set forth in claim 3, wherein said adjustably pivoting means comprises:
(a) adjusting bolt and nut means operatively connected between said carriage and one of said swivel brackets of each pair of tamping units, said adjusting bolt and nut means being operable manually for adjustably pivoting said one swivel bracket; and
(b) link means operatively connected between said swivel brackets of each pair of tamping units for pivoting the other swivel bracket in an opposite direction upon pivotal motion of said one swivel bracket.

* * * * *